US007994883B2

(12) United States Patent
Kuo

(10) Patent No.: US 7,994,883 B2
(45) Date of Patent: Aug. 9, 2011

(54) ELECTROMAGNETIC RELAY

(76) Inventor: Ming-Chang Kuo, Taichung (TW)

( * ) Notice: Subject to any disclaimer, the term of this patent is extended or adjusted under 35 U.S.C. 154(b) by 181 days.

(21) Appl. No.: 12/387,069

(22) Filed: Apr. 28, 2009

(65) Prior Publication Data

US 2010/0182109 A1 Jul. 22, 2010

(51) Int. Cl.
*H01H 51/22* (2006.01)

(52) U.S. Cl. ..... 335/78; 335/80

(58) Field of Classification Search ..... 335/78, 335/80

See application file for complete search history.

(56) References Cited

U.S. PATENT DOCUMENTS 4,429,292 A * 1/1984 Schedele ..... 335/202
4,695,813 A * 9/1987 Nobutoki et al. ..... 335/78
4,758,809 A * 7/1988 Bell ..... 335/128
4,816,794 A * 3/1989 Nagao et al. ..... 335/136
4,912,438 A * 3/1990 Yokoo ..... 335/78
4,914,411 A * 4/1990 Hikita et al. ..... 335/128
4,993,787 A * 2/1991 Tanaka et al. ..... 335/78
5,117,209 A * 5/1992 Sato ..... 335/80
5,608,366 A * 3/1997 Sako ..... 335/78
5,696,475 A * 12/1997 Yoshitani et al. ..... 335/78
6,107,903 A * 8/2000 Sako et al. ..... 335/78
6,111,487 A * 8/2000 Hoffmann et al. ..... 335/78
6,337,614 B1 * 1/2002 Tsutsui ..... 335/160
6,448,877 B1 * 9/2002 Harayama et al. ..... 335/78
6,606,018 B2 * 8/2003 Takano et al. ..... 335/78
6,611,184 B2 * 8/2003 Hoffmann ..... 335/78
6,633,214 B2 * 10/2003 Mochizuki ..... 335/128
6,731,190 B2 * 5/2004 Yamashita et al. ..... 335/78
2001/0033213 A1 * 10/2001 Swartzentruber et al. ..... 335/78
2002/0008600 A1 * 1/2002 Breitlow-Hertzfeldt et al. ..... 335/78
2003/0218522 A1 * 11/2003 Nakamura et al. ..... 335/78

* cited by examiner

*Primary Examiner* — Elvin G Enad
*Assistant Examiner* — Alexander Talpalatskiy
(74) *Attorney, Agent, or Firm* — John A. Fortkort; Fortkort & Houston P.C.

(57) ABSTRACT

An electromagnetic relay includes a casing, and a relay core member sealed in the casing and including an electromagnetic unit and a terminal unit. The electromagnetic unit includes a spool frame set having an engagement portion, a coil unit wound on the spool frame set, and a pair of coil winding pins. Each of the coil winding pins has a conductive portion exposed from one of opposite first sides of the spool frame set, and a coil winding portion extending along one of opposite second sides of the spool frame set. The terminal unit includes an engaging block having an engagement portion connected to the engagement portion of the spool frame set for preventing separation of the terminal unit from the electromagnetic unit, a terminal set, and an armature component.

8 Claims, 10 Drawing Sheets

ELECTROMAGNETIC RELAY

BACKGROUND OF THE INVENTION

1. Field of the Invention

The present invention relates to an electromagnetic relay, more particularly to an electromagnetic relay including an armature component supported pivotally at a middle portion thereof.

2. Description of the Related Art

Referring to FIGS. 1 and 2, U.S. Pat. No. 4,881,053 discloses an electromagnetic relay 1 including a casing 11, an electromagnet block 12 and a base 13 sealed in the casing 11, and an armature block 135. The electromagnet block 12 includes a spool 121, two pairs of junction terminals 123 having coil winding portions 122 exposed from opposite longitudinal sides of the spool 121, and coils 124 wound on the spool 121. Each of the coils 124 has one end that is to be wound on one of the coil winding portions 122 of the corresponding pair of the junction terminals 123, and the other end that is to be wound on the other one of the coil winding portions 122 of the corresponding pair of the junction terminals 123. The base 13 includes a base body 131 for accommodating the electromagnet block 12, a pair of common terminals 132 and two pairs of fixed contact terminals 133 inserted into the base body 131 and spaced apart from each other, and two pairs of coil terminals 134 connected respectively and electrically to the junction terminals 123. The armature block 135 is connected electrically to the common terminals 132, and is supported pivotally by the electromagnet block 12.

When the armature block 135 is affected by an electromagnetic field generated by the electromagnet block 12, the armature block 135 is brought into contact with left fixed contacts, so as to establish electrical connection between the common terminals 132 and the left fixed contact terminals 133 while breaking electrical connection between the common terminals 132 and the right fixed contact terminals 133. When the electromagnetic field is not generated, the armature block 135 is brought into contact with right fixed contacts, so as to establish electrical connection between the common terminals 132 and the right fixed contact terminals 133 while breaking electrical connection between the common terminals 132 and the left fixed contact terminals 133. Therefore, the electromagnetic relay 1 can serve as a switch unit.

However, because the coil winding portions 122 of each pair of the junction terminals 123 project from the spool 121 away from each other, the size of the base body 131 is relatively large in order to accommodate the entire electromagnet block 12. Moreover, since there is no mechanism for fixing the electromagnet block 12 in the base body 131, it is difficult to connect the junction terminals 123 accurately to the coil terminals 134 during assembly. Further, the common, fixed contact, and coil terminals 132, 133, 134 are manually welded on both sides of the base body 131, so that the electromagnetic relay 1 cannot be fabricated at a high rate.

SUMMARY OF THE INVENTION

Therefore, an object of the present invention is to provide an electromagnetic relay that is easy to assemble and that can be fabricated at a high rate.

Accordingly, an electromagnetic relay of this invention comprises a casing, and a relay core member that is sealed in the casing, and that includes an electromagnetic unit and a terminal unit.

The electromagnetic unit is adapted for generating an electromagnetic field, and includes a spool frame set that includes a pair of opposite first sides and a pair of opposite second sides, a coil unit wound on the spool frame set, and a pair of coil winding pins. Each of the coil winding pins has a conductive portion exposed from one of the first sides, and a coil winding portion extending along one of the second sides. The spool frame set further includes an engagement portion.

The terminal unit includes an engaging block including an engagement portion connected to the engagement portion of the spool frame set of the electromagnetic unit for preventing separation of the terminal unit from the electromagnetic unit, a terminal set exposed from the casing, and an armature component being affected by the electromagnetic field generated by the electromagnetic unit and serving as a switch mechanism by cooperating with the terminal set.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
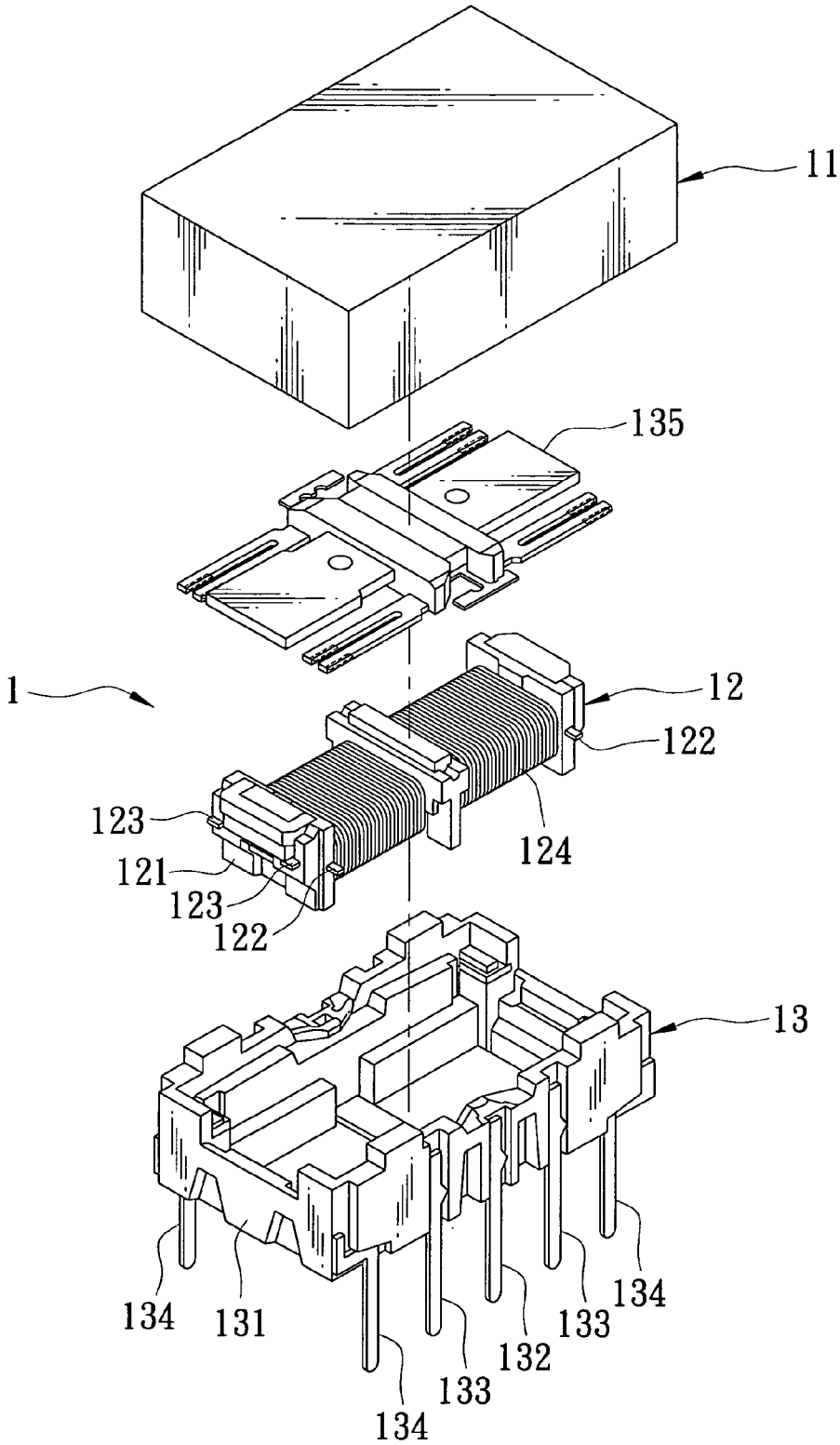
FIG. 1 PRIOR ART
FIG. 1 is a partly exploded perspective view illustrating an electromagnetic relay disclosed in U.S. Pat. No. 4,881,053.
Figure 2:
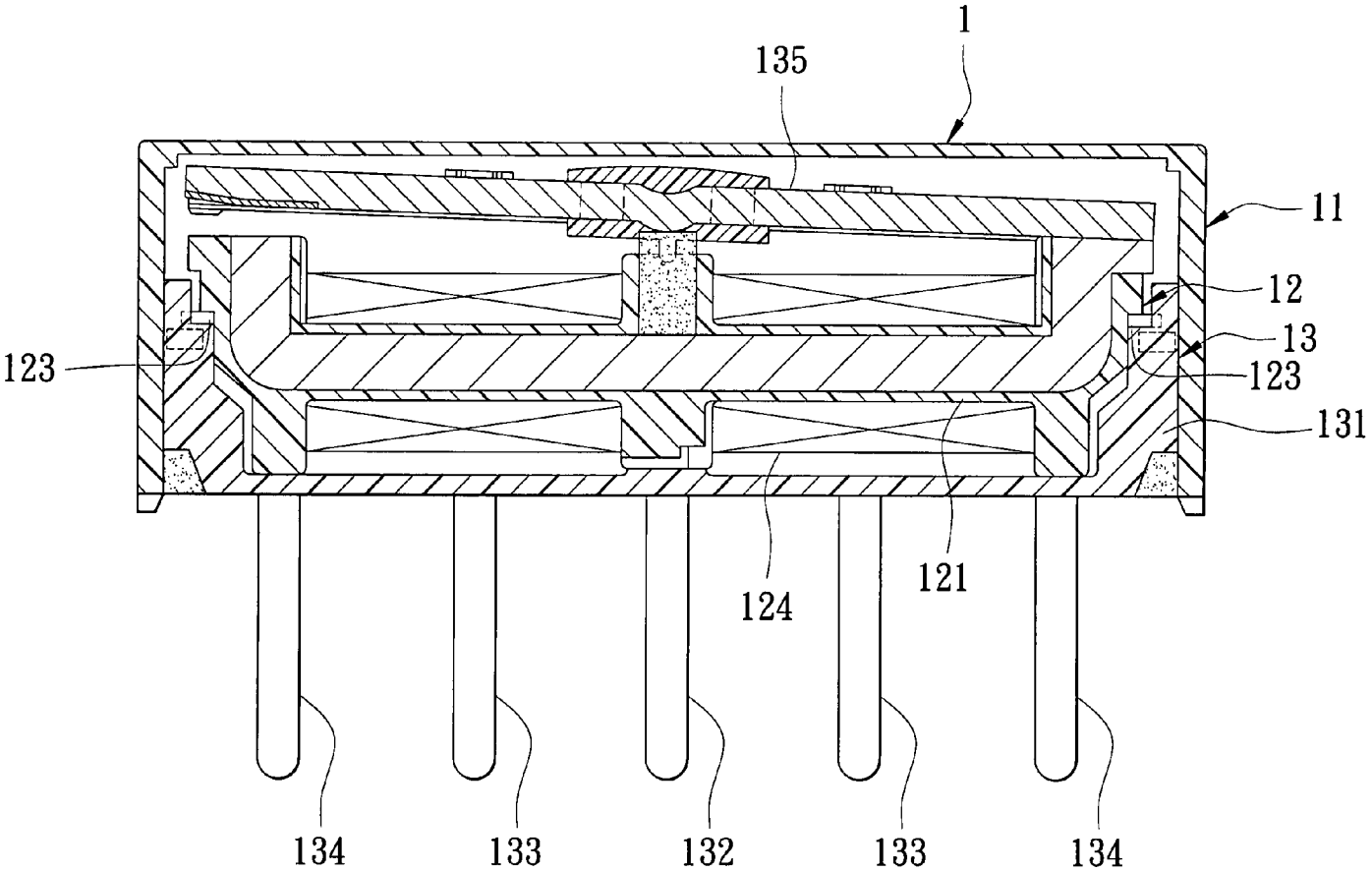
FIG. 2 PRIOR ART
FIG. 2 is a sectional view of the electromagnetic relay disclosed in U.S. Pat. No. 4,881,053.
Figure 3:
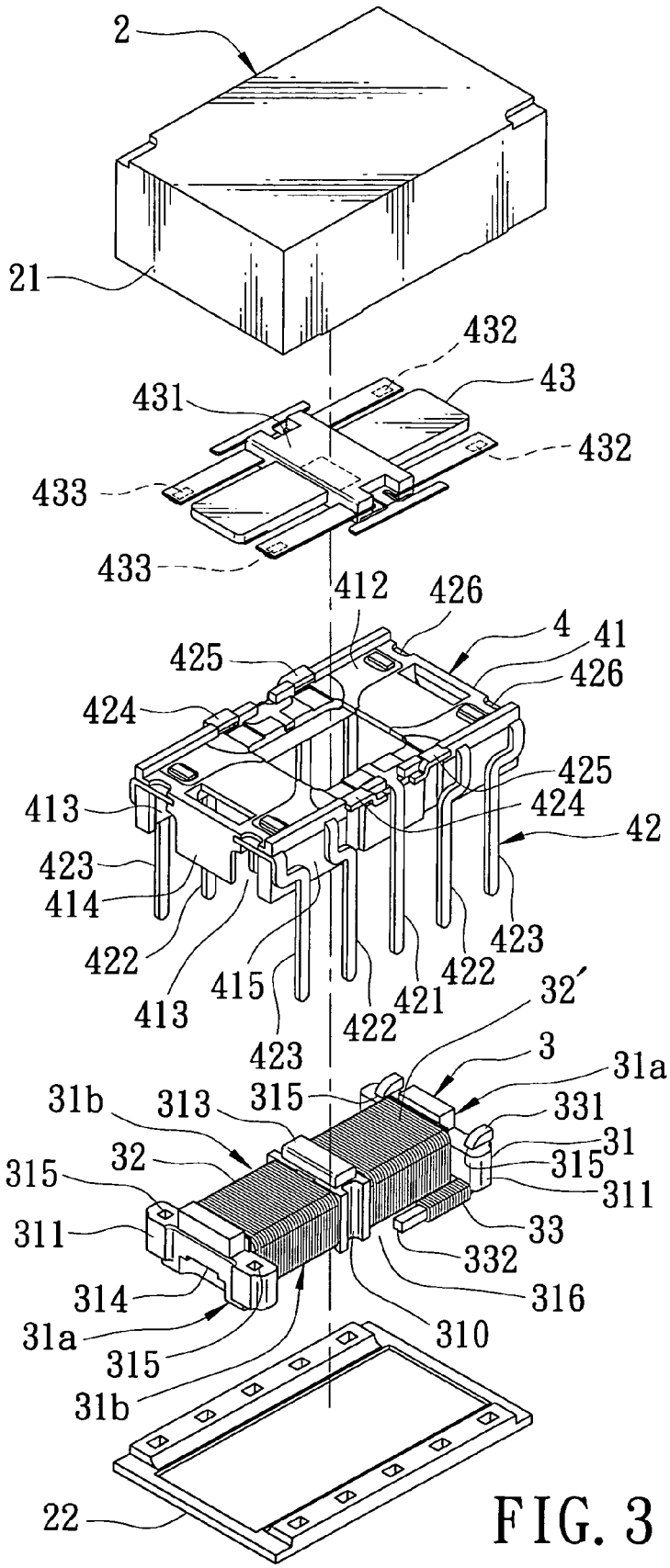
FIG. 3 is a partly exploded perspective view illustrating a preferred embodiment of an electromagnetic relay of the present invention.
Figure 4:
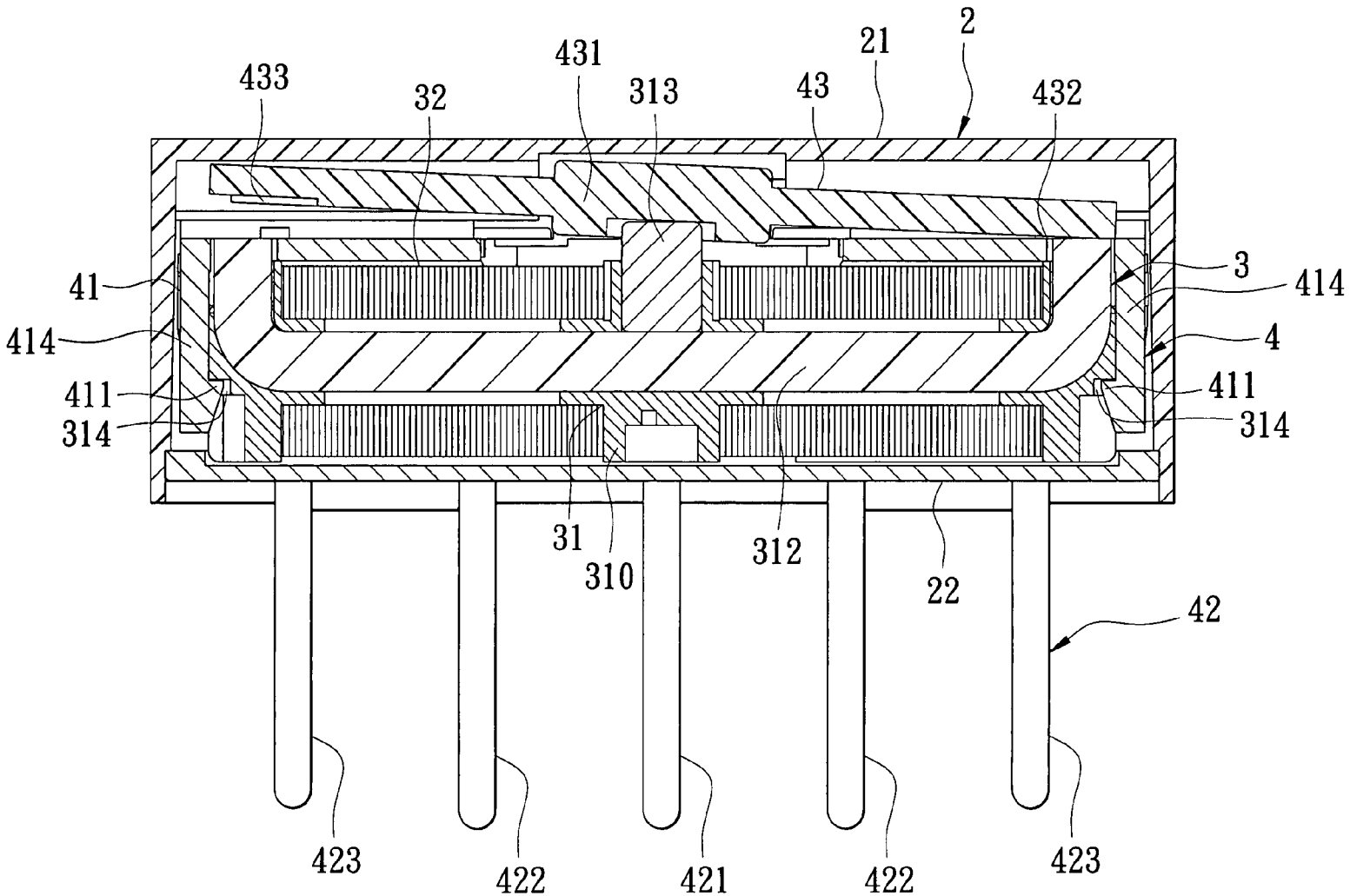
FIG. 4 is a sectional view of preferred embodiment.

Referring to FIGS. 3 and 4, an electromagnetic relay of the preferred embodiment of this invention includes a casing 2 and a relay core member including an electromagnetic unit 3 and a terminal unit 4.

The casing 2 includes an upper casing body 21 and a bottom casing body 22 that are connected with each other by press fitting.

The electromagnetic unit 3 is adapted for generating an electromagnetic field, and includes a spool frame set 31 having a pair of opposite first sides (31*a*) and a pair of opposite second sides (31*b*), a coil unit 32 being wound on the spool frame set 31 and including at least one coil 32', and a pair of coil winding pins 33. The spool frame set 31 includes a spool frame 310 wound with the coil unit 32, a pair of mounting frames 311, an iron core 312 attached fixedly to the spool frame 310, and a permanent magnet 313 inserted into the spool frame 310 and disposed on a middle portion of the iron core 312. Each of the mounting frames 311 is disposed at and extends along a respective one of the first sides (31*a*) of the spool frame set 31, and has a pair of through holes 315 formed therethrough and spaced apart from each other. Further, each of the mounting frames 311 includes an outer surface formed with a groove 314. Each of the coil winding pins 33 has a conductive portion 331, and a coil winding portion 332 extending along one of the second sides (31*b*) of the spool frame set 31. Each of the conductive portions 331 has a horizontal section being exposed from one of the mounting frames 311, and a vertical section extending into a corresponding one of the through holes 315. One end of each of the conductive portions 331 is aligned with an outer surface of the corresponding mounting frame 311, and the coil winding portions 332 of the coil winding pins 33 are disposed in a space 316 defined by the mounting frames 311.

Figure 10:
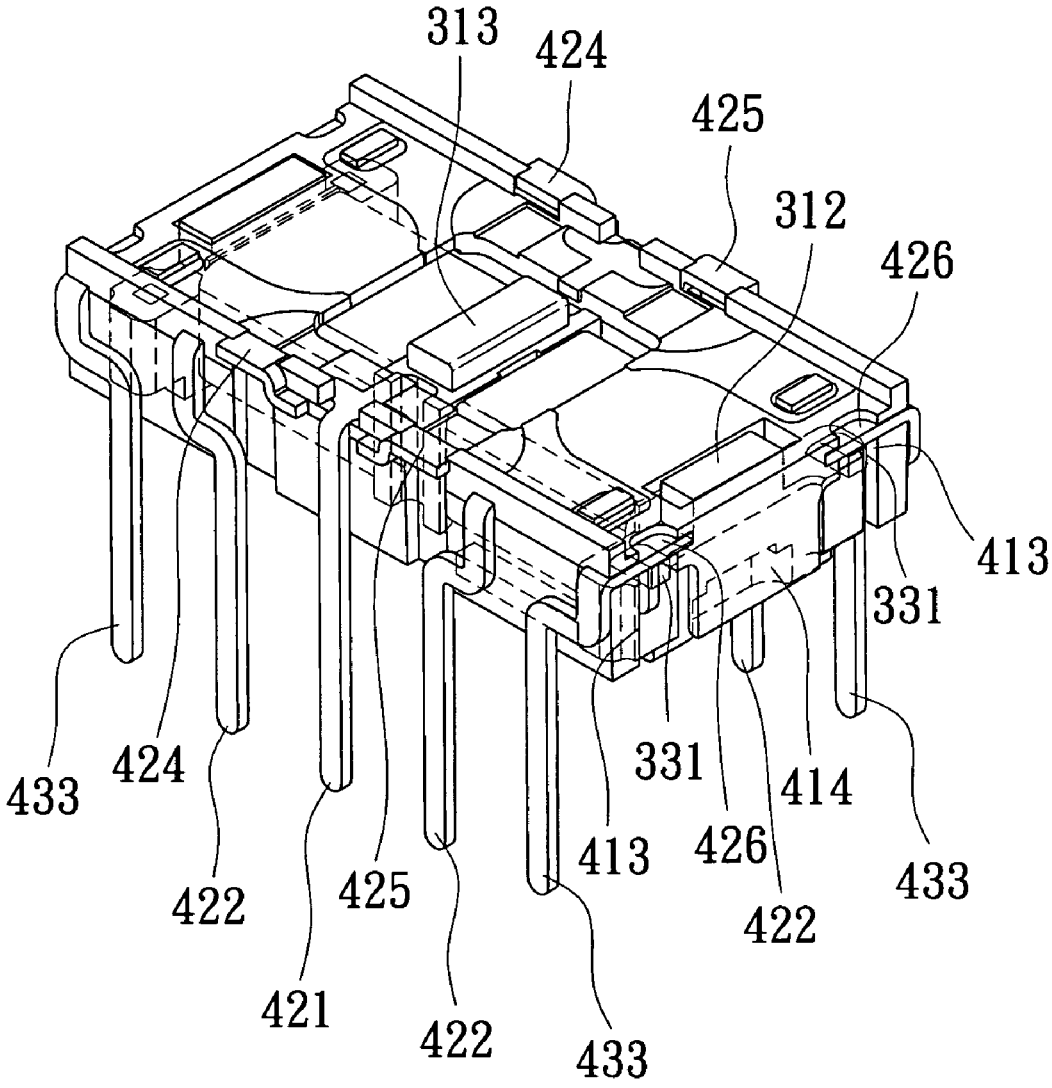
FIG. 10 is a rear perspective view of the relay core member of the electromagnetic relay of the preferred embodiment in FIG. 9.

The terminal unit 4 includes an engaging block 41 configured for accommodating the electromagnetic unit 3, a terminal set 42 inserted into the engaging block 41 and exposed from the bottom casing body 22 of the casing 2, and an armature component 43 being affected by the electromagnetic field generated by the electromagnetic unit 3 and serving as a switch mechanism by cooperating with the terminal set 42. The engaging block 41 includes a pair of opposite sidewalls 414 corresponding respectively to the first sides (31*a*) of the spool frame set 31, a pair of opposite side surfaces 415 corresponding respectively to the second sides (31*b*) of the spool frame set 31, a pair of barbs 411 disposed respectively on inner surfaces of the sidewalls 414, and a top surface 412 confronting the armature component 43. Each of the sidewalls 414 of the engaging block 41 is formed with a pair of notches 413, and the horizontal sections of the conductive portions 331 of the coil winding pins 33 are disposed respectively within the notches 413 (see FIG. 10). Each of the barbs 411 is configured for engaging with a corresponding one of the grooves 314 for preventing separation of the terminal unit 4 from the electromagnetic unit 3. The terminal set 42 includes a pair of common terminals 421, two pairs of fixed contact terminals 422, and two pairs of coil terminals 423. Each of the common, fixed contact and coil terminals 421, 422, 423 is inserted into the top surface 412, and has a portion extending along a corresponding one of the side surfaces 415. The engaging block 41 further includes two pairs of first welding points 424, 425 disposed on the top surface 412 thereof, and a pair of second welding points 426 disposed within the notches 413. The coil terminals 423 are respectively welded to the conductive portions 331 of the coil winding pins 33 at the second welding points 426 for forming electrical connection therebetween. The armature component 43 includes a middle contact portion 431 welded to the common terminals 421 at the welding points 424, 425 and supported pivotally by the spool frame set 31, and two pairs of movable contact portions 432, 433 disposed respectively at two opposite end portions of the armature component 43.

Figure 5:
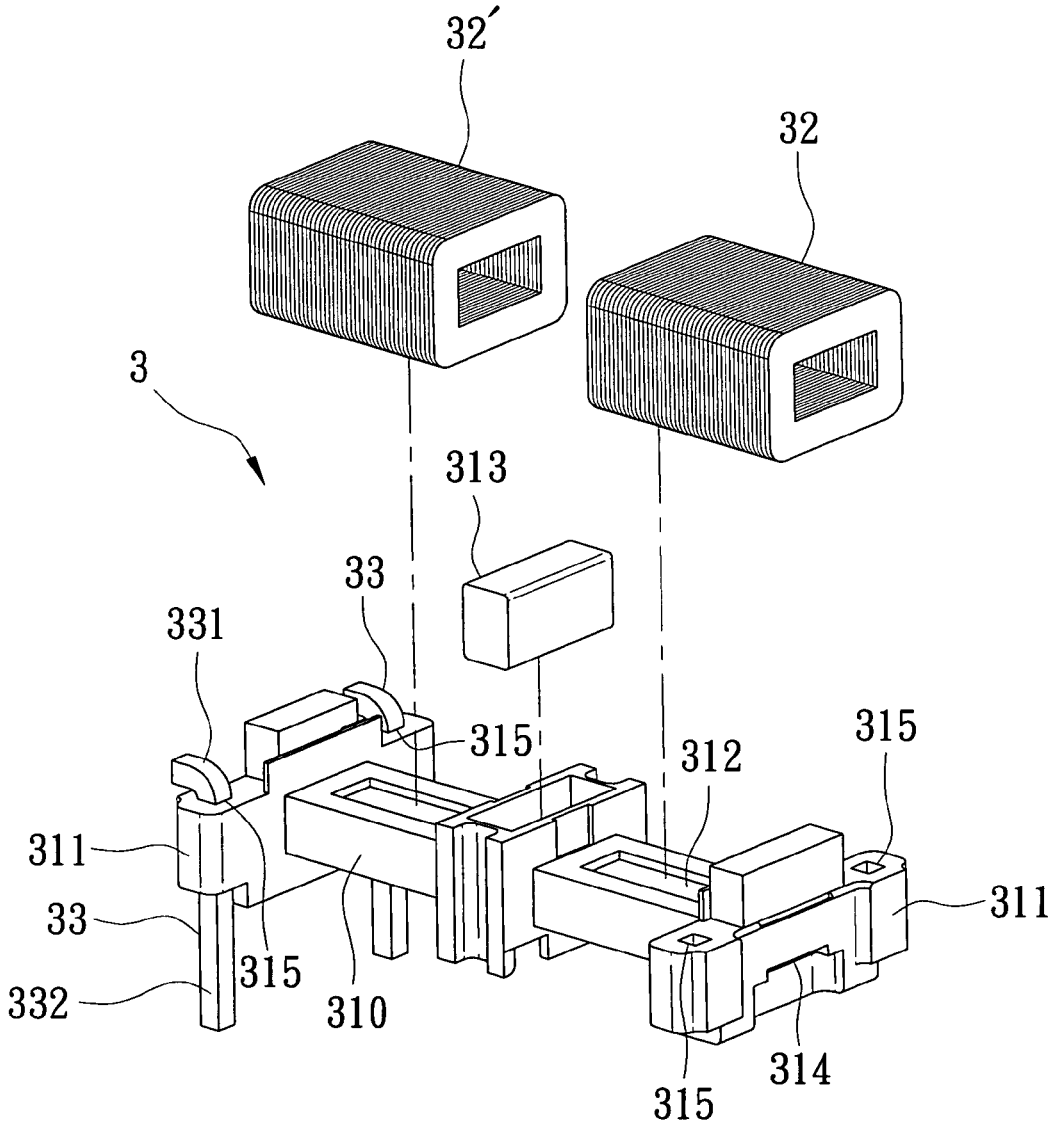
FIG. 5 is an exploded perspective view of a semi-product of an electromagnetic unit of the electromagnetic relay of the preferred embodiment, wherein a pair of coil winding pins are inserted through a spool frame set.
Figure 6:
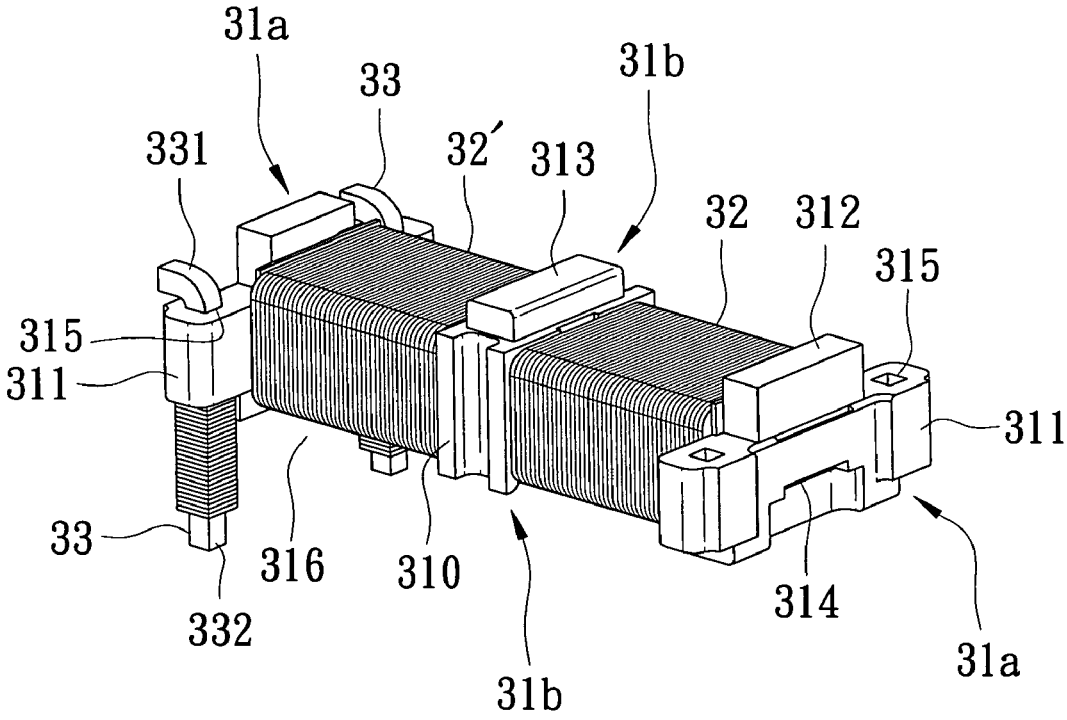
FIG. 6 is a perspective view of the semi-product of the electromagnetic unit, wherein the coil winding pins have yet to be bent.

Referring to FIG. 5, the coil winding pins 33 are first inserted through the through holes 315 in one of the mounting frames 311 of the spool frame set 31 when assembling the electromagnetic unit 3. Referring to FIG. 6, next, one end of the coil 32' is wound on the coil winding portion 332 of one of the coil winding pins 33, and then the coil 32' is wound on the spool frame 310 followed by winding the other end of the coil 32' on the coil winding portion 332 of the other one of the coil winding pins 33. In practice, the ends of the coil 32' can be fixed on the coil winding portions 332 of the coil winding pins 33 by welding with soldering tin.

Figure 7:
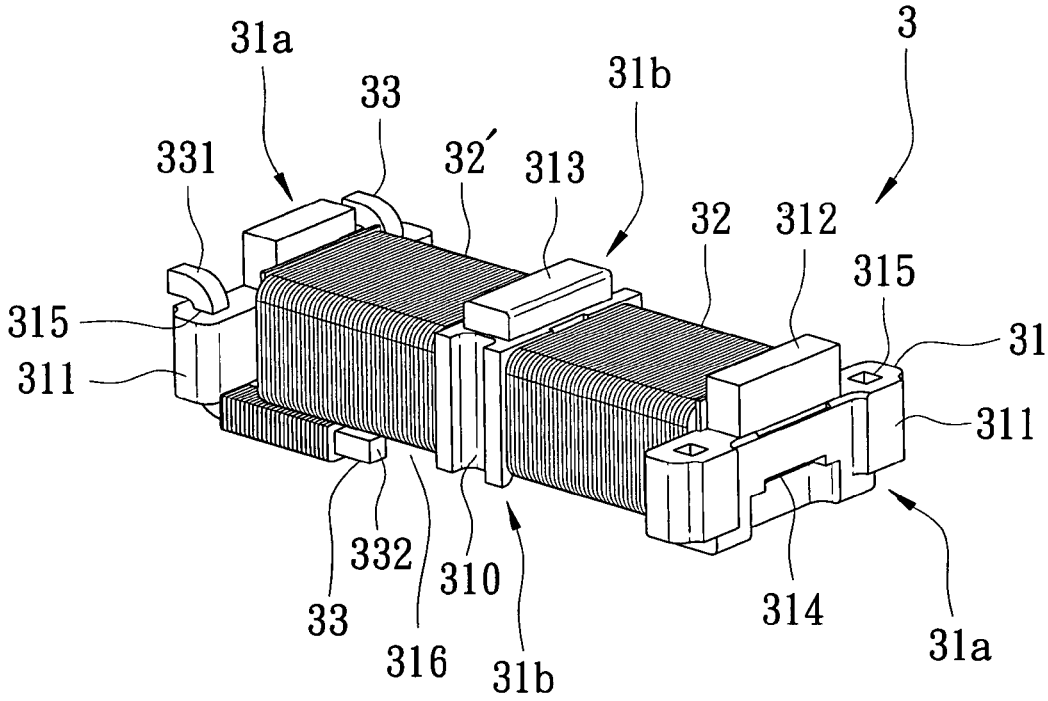
FIG. 7 is a perspective view of the final product of the electromagnetic unit, wherein the coil winding pins are bent.

Referring to FIG. 7, subsequently, each of the coil winding portions 332 of the coil winding pins 33 is bent upwardly and toward the corresponding one of the second sides (31*b*) of the spool frame set 31. Therefore, the spool frame set 31, the coil unit 32, and the coil winding pins 33 are assembled together to form the electromagnetic unit 3.

Figure 8:
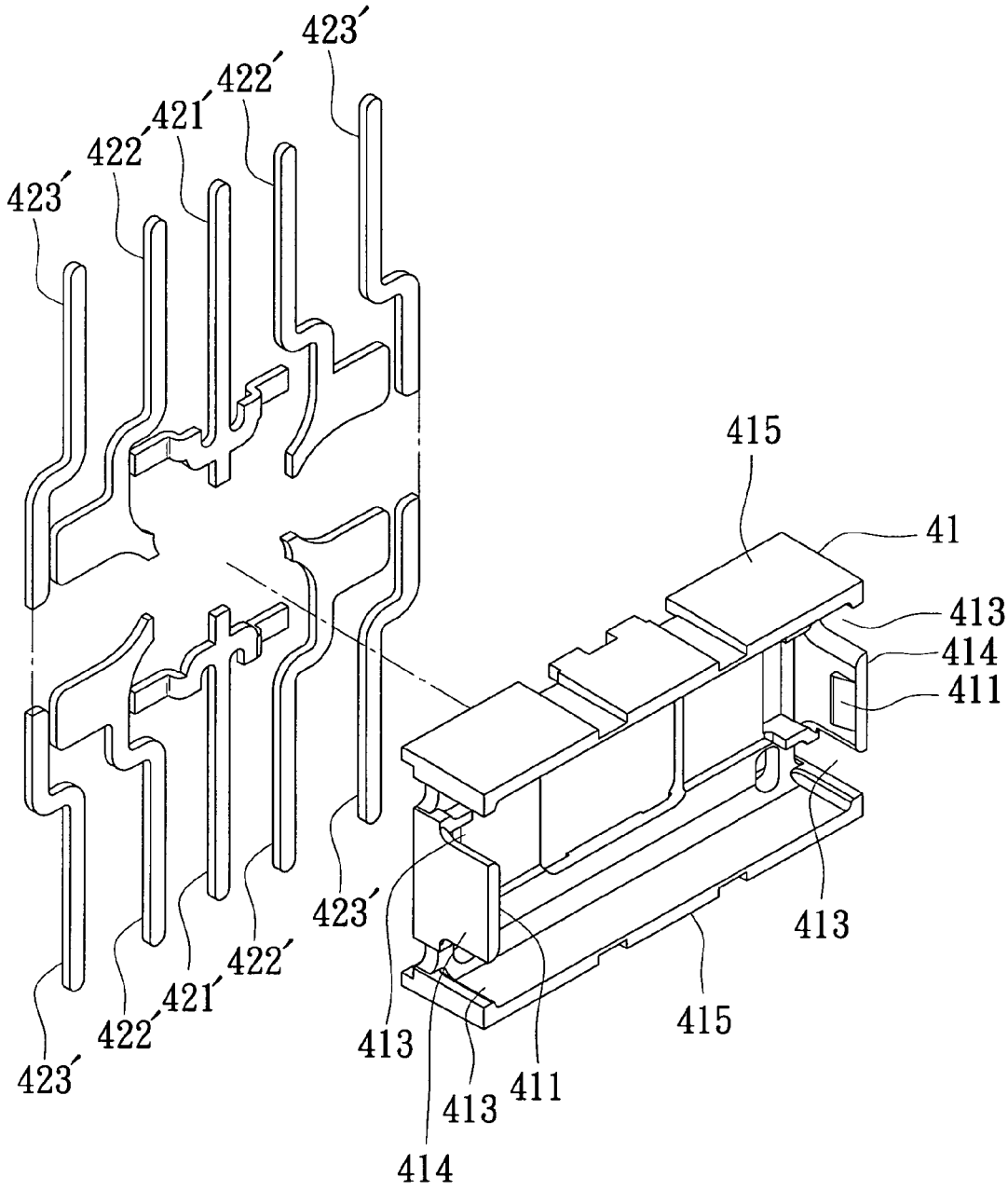
FIG. 8 is an exploded perspective view of an engaging block and a terminal set of the electromagnetic relay of the preferred embodiment.
Figure 9:
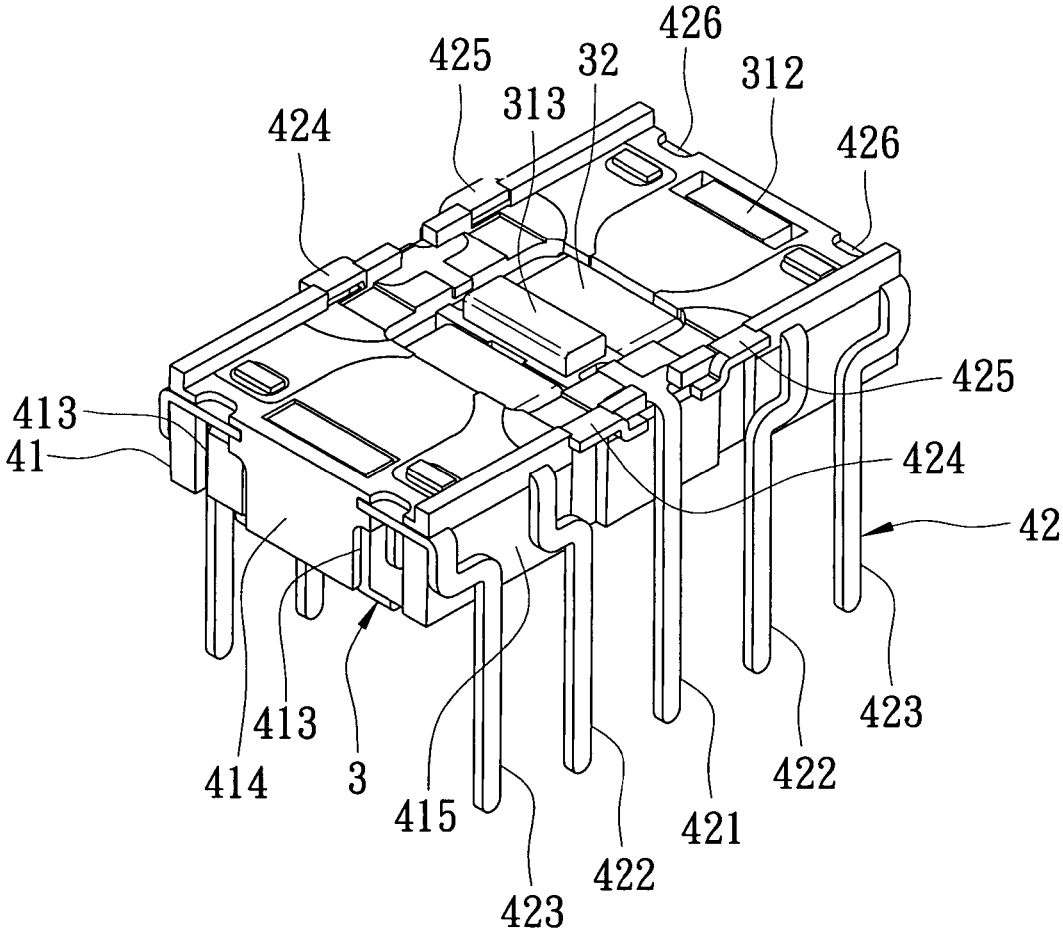
FIG. 9 is a front perspective view of a relay core member of the electromagnetic relay of the preferred embodiment.

Further referring to FIG. 8, the terminal set 42 is formed from a plate. The plate is embedded partially in the engaging block 41 such that it has a plurality of plate portions 421', 422', 423' corresponding to the terminals 421, 422, 423 (see FIG. 3), and then is bent to form the terminals 421, 422, 423 such that upper ends of the coil terminals 423 are disposed respectively in the notches 413 in the engaging block 41. Further referring to FIG. 9, the electromagnetic unit 3 is inserted into the engaging block 41, and each of the grooves 314 in the mounting frames 311 of the spool frame set 31 engages a corresponding one of the barbs 411 of the engaging block 41. Therefore, the electromagnetic unit 3 and the terminal unit 4 are assembled together to form the relay core member. At this time, the coil terminals 423 of the terminal set 42 are respectively in electrical contact with the conductive portions 331 of the coil winding pins 33.

Subsequently, the common terminals 421 are welded to the middle contact portion 431 of the armature component 43, and the coil terminals 423 are welded to the conductive portions 331 of the coil winding pins 33 at the welding points 424, 425, 426, respectively, using laser welding method. Referring to FIG. 4, the relay core member including the electromagnetic unit 3 and the terminal unit 4 is finally sealed in the casing 2, and the terminal set 42 is exposed from the bottom casing body 22 of the casing 2.

When a voltage is applied to the coil terminals 423 to pass electric current through the coil 32', the electromagnetic unit 3 generates the electromagnetic field so as to attract the right movable contact portions 432 of the armature component 43. Therefore, each of the right movable contact portions 432 is pivoted to a connection position, where the corresponding right movable contact portion 432 is electrically connected to a corresponding one of the fixed contact terminals 422. When no voltage is applied to the coil terminals 423, the electromagnetic field is not generated, and therefore each of the right movable contact portions 432 of the armature component 43 is biased to a disconnection position, where the corresponding right movable contact portion 432 is separated from the corresponding one of the fixed contact terminals 422. Thus, the armature component 43 serves as a switch mechanism.

It should be noted that the electromagnetic unit 3 can also include two pairs of the coil winding pins 33 (not shown), so that the electromagnetic relay of this invention serves as a double-pole-double-throw (DPDT) relay to transmit two control signals. Techniques for transmitting two control signals and the DPDT relay are existing techniques, and descriptions thereof will be omitted herein for the sake of brevity.

In sum, the electromagnetic relay of the present invention has the following advantages. First, because one end of each of the conductive portions 331 of the coil winding pins 33 is aligned with the outer surface of the corresponding one of the mounting frames 311, and the coil winding portions 332 are disposed in the space 316 between the mounting frames 311, it is possible to reduce the size of the electromagnetic unit 3. Second, the welding points 424, 425, 426 can be formed using laser welding method, such that the manufacturing process of the electromagnetic relay is relatively simple. Third, each of the barbs 411 engages a corresponding one of the grooves 314 for preventing separation of the terminal unit 4 from the electromagnetic unit 3, so that the coil terminals 423 can be connected accurately to the coil winding pins 33 during assembly of the electromagnetic relay. Therefore, an automated manufacturing process can be utilized for the electromagnetic relay of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electromagnetic relay comprising:

a casing; and a relay core member sealed in said casing, said relay core member including an electromagnetic unit adapted for generating an electromagnetic field, said electromagnetic unit including a spool frame set that includes a pair of opposite first sides and a pair of opposite second sides, a coil unit wound on said spool frame set, and a pair of coil winding pins, each of said coil winding pins having a conductive portion exposed from one of said first sides and a coil winding portion extending along one of said second sides, said spool frame set further including an engagement portion and a pair of mounting frames, each of said mounting frames being disposed at and extending along a respective one of said first sides of said spool frame set, and being formed with a pair of through holes formed through a corresponding one of said mounting frames and spaced apart from each other, each of said conductive portions including a horizontal section being exposed from one of said mounting frames and a vertical section extending into a corresponding one of said through holes, and a terminal unit that includes an engaging block including an engagement portion connected to said engagement portion of said spool frame set of said electromagnetic unit for preventing separation of said terminal unit from said electromagnetic unit, a terminal set exposed from said casing, and an armature component being affected by the electromagnetic field generated by said electromagnetic unit and serving as a switch mechanism by cooperating with said terminal set.

2. The electromagnetic relay as claimed in claim 1, wherein:

said engaging block is configured for accommodating said electromagnetic unit, and further includes a pair of opposite sidewalls corresponding respectively to said first sides of said spool frame set and a pair of barbs disposed respectively on said sidewalls and constituting cooperatively said engagement portion of said terminal unit;

said terminal set is embedded partially in said engaging block; and each of said mounting frames includes an outer surface formed with a groove configured for engaging with a corresponding one of said barbs, said grooves in said mounting frames constituting cooperatively said engagement portion of said spool frame set.

3. The electromagnetic relay as claimed in claim 2, wherein said engaging block further includes a pair of notches, and said horizontal sections of said conductive portions of said coil winding pins are disposed respectively within said notches, said coil winding portions of said coil winding pins being disposed in a space defined by said mounting frames.

4. The electromagnetic relay as claimed in claim 1, wherein said engaging block includes a pair of opposite side surfaces, and said terminal set of said terminal unit includes a pair of common terminals, two pairs of fixed contact terminals, and two pairs of coil terminals, each of said common, fixed contact and coil terminals having a portion that extends along a corresponding one of said side surfaces, said coil terminals being respectively and electrically connected to said conductive portions of said coil winding pins.

5. The electromagnetic relay as claimed in claim 4, wherein said armature component includes a middle contact portion electrically connected to said common terminals and supported pivotally by said spool frame set, and a pair of movable contact portions that are disposed respectively at two opposite end portions of said armature component, each of said movable contact portions being pivotable between a connection position, where a corresponding one of said movable contact portions is connected electrically to a corresponding one of said fixed contact terminals, and a disconnection position, where the corresponding one of said movable contact portions is separated from the corresponding one of said fixed contact terminals.

6. The electromagnetic relay as claimed in claim 5, wherein said engaging block of said terminal set further includes a top surface having a plurality of welding points, said common terminals being welded to said middle contact portion of said armature component and said coil terminals being welded to said conductive portions of said coil winding pins at said welding points, respectively.

7. The electromagnetic relay as claimed in claim 6, wherein said welding points are formed using laser welding method.

8. The electromagnetic relay as claimed in claim 1, wherein said casing includes an upper casing body and a bottom casing body that are connected with each other by press fitting, and said bottom casing body is further configured to permit said terminal set to be exposed therefrom.

* * * * *